US005882363A

United States Patent [19]

Spaulding et al.

[11] Patent Number: 5,882,363

[45] Date of Patent: Mar. 16, 1999

[54] CLEAR COMPOSITIONS FOR USE IN SOLID TRANSPARENT CANDLES

[75] Inventors: Laura A. Spaulding, Wayne; Robert V. Burke, Closter, both of N.J.

[73] Assignee: The Noville Corporation, South Hackensack, N.J.

[21] Appl. No.: 73,844

[22] Filed: May 7, 1998

[51] Int. Cl.[6] ..... C10L 5/00

[52] U.S. Cl. ..... 44/275; 44/266; 431/288

[58] Field of Search ..... 44/266, 270, 272, 44/275; 431/288

[56] References Cited

U.S. PATENT DOCUMENTS

| | | | |
|---|---|---|---|
| 3,148,125 | 9/1964 | Sabbat et al. | 167/85 |
| 3,341,465 | 9/1967 | Kaufman et al. | 252/316 |
| 3,563,767 | 2/1971 | Wasserman et al. | 44/270 |
| 3,615,289 | 10/1971 | Felton | 44/275 |
| 3,645,705 | 2/1972 | Miller et al. | 44/275 |
| 3,819,342 | 6/1974 | Gunderman et al. | 44/275 |
| 3,844,706 | 10/1974 | Tsaras | 44/275 |
| 4,275,054 | 6/1981 | Sebag et al. | 424/65 |
| 4,332,548 | 6/1982 | Linton et al. | 44/275 |
| 5,500,209 | 3/1996 | Ross et al. | 424/66 |
| 5,578,089 | 11/1996 | Elsamaloty | 44/275 |
| 5,603,925 | 2/1997 | Ross et al. | 424/65 |

FOREIGN PATENT DOCUMENTS

| | | | |
|---|---|---|---|
| WO 97/08282 | 3/1997 | WIPO | C11C 5/00 |
| WO 97/36573 | 10/1997 | WIPO | A61K 7/48 |

*Primary Examiner*—Margaret Medley
*Attorney, Agent, or Firm*—Kenyon & Kenyon

[57] ABSTRACT

The present invention relates to clear solid compositions that may be used as the base material of a transparent candle, to the transparent candles made therefrom, and to methods of making the same. The compositions of the present invention comprise one or more polyamide resins, which may be present in a total amount of about 40–70% by weight of the composition; and one or more 12-hydroxystearic acid ester solvents, which may be present in a total amount of about 10–70% by weight of the composition, having the following chemical structure:

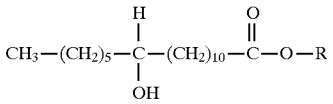

and wherein R may by selected from the group consisting of alkyl radicals, aryl radicals, and arylalkyl radicals.

34 Claims, No Drawings

CLEAR COMPOSITIONS FOR USE IN SOLID TRANSPARENT CANDLES

FIELD OF INVENTION

The present invention relates to clear solid compositions that are useful as the base material of a transparent candle, to the transparent candles made therefrom, and to methods of making the same.

BACKGROUND OF THE INVENTION

While the burning of a candle might appear to be simple and uninvolved, the process that takes place in the burning of a candle has been described, in fact, as a process that imposes rather stringent requirements upon the candle body material, U.S. Pat. Nos. 5,578,089, 3,819,342, 3,645,705 and 3,615,289. This is illustrated, in particular, with respect to the actual burning of the candle when the heat of the candle's flame melts a small pool of the candle body material around the base of the exposed portion of the wick. This molten material is then drawn up through and along the wick by capillary action to fuel the flame. A candle's melting point is, therefore, important in that the candle material should liquefy at or below temperatures to which the candle's material can be raised by radiant heat from the candle flame. If the candle's melting temperature is too low, the candle will drip or, in an extreme case, the entire candle body will melt, dropping the wick into a pool of molten body material, with the potential that the surface of the pool could ignite. If too high a temperature is required to melt the body material, the flame will be starved because insufficient fuel will be drawn up through the wick, with the result that the flame will be too small to maintain itself. Moreover, when molten, the candle body material preferably has a relatively low viscosity to insure that it will be capable of being drawn up through the wick by capillary action. In addition to meeting the above requirements, it is preferred that the candle body material burn with a flame that is both luminous and smokeless, and that the odors produced by its combustion should not be unpleasant or intrusive.

The desire to make candles that are transparent or clear places still further demands on these already stringent requirements. The terms "clear" and "transparent" are used interchangeably herein and connote a substantial absence of cloudiness or obscurity, so that the body of the candle features an ability to let light pass through in a substantially unobstructed manner, and an ability to have coloring agent added to the composition without causing cloudiness or reducing the candle's ability to let light pass through in a relatively unobstructed manner. Preferably, the composition has a degree of clarity comparable to window glass, clear glassware, or water.

To add yet one more demand on transparent candle compositions, it would also be desirable if the transparent candles could be used as a fragrance carrier for dispersing selected fragrances, such as fragrances having a pleasant odor, or fragrances that repel insects.

Transparent compositions used to make transparent candles typically have one or more undesirable characteristics. In particular, such compositions typically do not have enough rigidity to form a self-supporting candle, and require some type of container or external support. Such compositions also typically lack hardness, which may lead to an undesirable gelatinous feeling. In addition, such compositions may darken or smoke during burning, which is aesthetically undesirable.

Known transparent candle compositions which are comprised of a thermoplastic polyamide resin and a flammable solvent for solubilizing the resin, such as described in U.S. Pat. Nos. 3,615,289 and 3,819,342 are vulnerable to auto-ignition, and tend to sweat, produce black smoke, and darken during burning. Sweating is the process whereby oils migrate out of the candle body to the surface, giving it an oily texture, and is most commonly caused by syneresis. Syneresis occurs whenever oil is physically squeezed out from the candle body because of excessive chemical cross linking. Sweating is not only an aesthetic drawback, but can be a performance or safety problem as well. If a candle sweats, the oil on the surface is available to ignite, which can result in an uncontrolled or torch-like situation rather than a candle.

U.S. Pat. No. 5,578,089 describes a heterophase thermally reversible mineral oil gel formed by a system of physically crosslinked block copolymers which purportedly overcome the problem of sweating and syneresis by adjusting the ratio of diblock and triblock polymers so as to ensure that all the oil remains entrained within a system of physically crosslinked copolymers. The thermoplastic rubber type polymers of U.S. Pat. No. 5,578,029 consist of block segments of styrene monomer units and rubber monomer units, wherein each block segment may consist of 100 monomer units or more (col. 7, lines 4–20). While such compositions are alleged to provide an improvement over the prior art transparent candle compositions, styrene/rubber-based candle compositions are susceptible to surface ignition, which may produce black smoke, and also have limited fragrance throw.

It would be desirable to have transparent and odorless compositions that could be used to prepare self-supporting transparent candles that do not have a gelatinous feeling. It would also be desirable to have compositions that can be used to make self-supporting transparent candles that have an aesthetically attractive appearance and that can burn safely and cleanly. It would also be desirable if fragrances could be readily dissolved in the composition without causing cloudiness or hazing.

The present invention is directed toward self-supporting transparent candle compositions that provide these advantages while not being handicapped with the above-noted disadvantages.

SUMMARY OF THE INVENTION

The present invention is directed to clear solid compositions that are useful as the base material for transparent candle compositions that bum safely and cleanly and which may be used for dispensing fragrances.

More specifically, the present invention relate to a composition for use in a clear solid candle, comprising: one or more gellants, and one or more 12-hydroxystearic acid ester solvents, where a 12-hydroxystearic acid ester solvent has the following chemical structure:

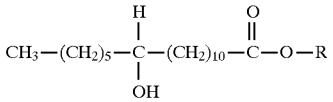

and where R may by selected from the group consisting of alkyl radicals, aryl radicals, and arylalkyl radicals.

As a representative embodiment, the present invention is directed to a clear composition for use in a clear solid candle, that contains octylhydroxystearate, a 12-hydroxystearic acid ester solvent, in an amount of about 10% to about 70%, wherein octylhydroxystearate has the following chemical structure:

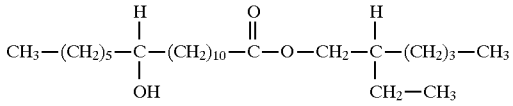

Preferably, the composition has a high degree of clarity, with little or no haze or cloudiness, and more preferably the composition is crystal clear, even when fragrances or coloring agents have been added. Preferably, the composition does not darken or smoke when a candle made of the composition is burning. Preferably, candles made of the composition do not crack or split during burning, nor suffer from syneresis. Preferably, candles made of the composition have a wide pool, which provides greater fragrance throw and helps avoid tunneling. Preferably, the composition is rigid enough to form a self-supporting candle, and avoids an undesirable gelatinous feel. Preferably, the composition is thermoreversible, such that the pool solidifies after the candle is extinguished, without significant change to the properties of the composition. Preferably, a candle made of the composition retains structural integrity while burning, and the sides of the candle do not bulge out. Preferably, the composition does not superheat, and the surface of candles made of the composition remains cool to the touch while the candle is burning. Preferably, candles made of the composition have a burn rate of about 3–4 grams per minute.

The present invention is also directed to combinations of additional components that can be included in the composition to produce candles having enhanced or additional aesthetic and functional improvements. In particular, the additional materials that may be included in the transparent candle compositions include coupling agents, solubilizers, clarifiers, emulsifiers, and plasticizers. Also, a clear coating material may be applied to the candle to enhance hardness and mar resistance.

The present invention is also directed toward transparent candles made from the clear solid compositions disclosed herein, and methods of making such candles.

The transparent candles of the present invention are, in particular, characterized by being formed of a clear solid composition that is capable of burning with a smoke-free flame, and does not darken while the candle is burning. Moreover, the transparent candles formed of the clear solid composition are self-supporting, and do not require a container or external support, unlike clear gel candles. The transparent candles of the present invention also have other desirable aesthetic features, such as a waxy feel.

Further objectives and advantages of the subject invention will be apparent to those skilled in the art from the detailed description of the disclosed invention.

DETAILED DESCRIPTION

The subject invention will now be described in detail for specific preferred embodiments of the invention, it being understood that these embodiments are intended only as illustrative examples and the invention is not to be limited thereto.

As used herein, "composition" refers to a base material from which solid transparent candles can be made. The composition of the present invention includes a gellant and a solvent, mixed together. The gellant should be soluble in the solvent at elevated temperatures, and at room temperature after cooling. The composition should be liquid at elevated temperatures but solid at room temperature. The gellant provides structure to the candle, although the quality of that structure may be affected by many factors, such as the type and amount of solvent used, and the type and amount of other additives. The solvent binds to the gellant, and has a large effect on the burning characteristics of the candles, such as whether the candle smokes while burning, whether the pool darkens during burning, and the heat of the flame. Other factors, such as the type and size of the wick, and other components included in the base material, can also contribute to the burning characteristics.

The composition of the present invention includes one or more gellants, preferably totaling about 40–70% by weight of the composition, and more preferably about 50–60% by weight. Candles having the preferred range of gellants are more likely to have a larger pool size, and less likely to have internal or external cracking, or syneresis, although these problems can be addressed by the addition of other components rather than by adjusting the amount of gellant. Two classes of polyamides are typically soluble in solvents of interest, and are preferred gellants for the present invention: (1) polyamides based on terpolymers of simple nylons (such as DuPont ELVAMIDE® 8061, which is a terpolymer of nylon 6, nylon 66, and nylon 610); and (2) polyamides based on complex fatty acids, such as the VERSAMID® series of Henkel Corp. or the UNIREZ® series of Union Camp Corp. U.S. Pat. No. 5,500,209, which is incorporated herein by reference, provides a more detailed description of these polyamides. Preferably, the gellant is selected from the group consisting of polyamide resins and derivatives thereof. More preferably, the gellant is the polyamide resin VERSAMID® 1655, available from the Henkel Corporation located in Ambler, Pa.

The composition of the present invention also includes one or more solvents, preferably totaling about 10–70% by weight of the composition at least about 10% by weight, more preferably about 20–70% by weight at least 20% by weight, and more preferably about 35–45% by weight. Solvents suitable for use in the present invention include esters of 12-hydroxystearic acid with a monohydric or polyhydric alcohol, i.e., octylhydroxystearate and derivatives thereof. This class of solvents is referred to herein as "12-hydroxystearic acid esters," and has a chemical structure represented by the formula:

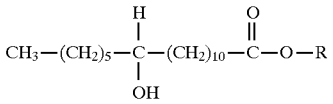

where R is selected from the group consisting of alkyl radicals, aryl radicals, and arylalkyl radicals. Preferably, R is selected from the group consisting of:

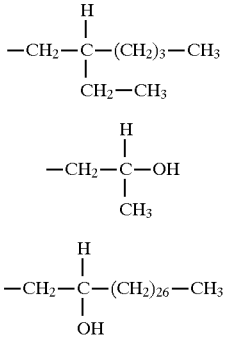

-continued

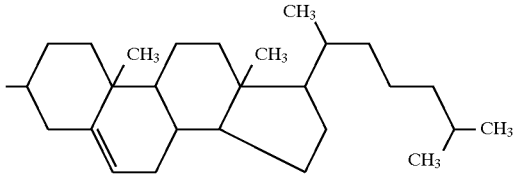

$-C_{10}H_{21}$ and $-(CH_2)_2-OH.$

More preferably, the solvent is octylhydroxystearate, which has a chemical structure represented by the formula:

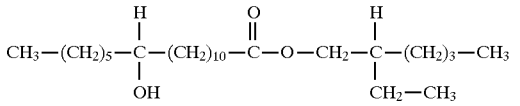

Octylhydroxystearate is available commercially as WICKENOL® 171 from Alzo, Inc., located in Matawan, N.J., or as CRODAMOL® OHS from Croda, Inc., located in Parsippany, N.J.

The solvent is a "reactive" solvent in the sense that the gellant binds with hydroxy group(s) on the solvent when the two components are mixed. For example, the VERSAMID® 1655 polyamide resin binds to the hydroxy group on the octylhydroxystearate when the two are mixed.

Clear candles may be made from a composition using VERSAMID® 1655 as the gellant and octylhydroxystearate as the solvent, along with other components as described below. It has been demonstrated that such a composition allows for the manufacture of a solid clear candle having several advantages. Such candles are hard to the touch and capable of self-support, and do not require a container. Also, such a candle does not significantly darken or smoke during burning.

Such a clear candle also has a desirable bum rate of 3–4 grams per hour, similar to a wax candle, and in contrast to styrene/rubber clear candles, which have a significantly slower burn rate on the order of 2 grams per hour. While not intending to be limited by any theory of how the present invention works, it is believed that the three oxygen atoms present in a single molecule of octylhydroxystearate lead to good oxygenation of the flame for a hotter burn and a faster burn rate.

The inventors analysis shows that the other solvents disclosed as suitable for use in the present invention, i.e., 12-hydroxystearic acid esters other than octylhydroxystearate, would have properties similar to those exhibited by octylhydroxystearate.

As used herein, "additional solvents" refers to solvents suitable for use in a candle, other than 12-hydroxystearic acid esters. Additional solvents include castor oil, oleic acid, or other conventional solvents known to the art, such as solvents disclosed in U.S. Pat. No. 3,819,342, which is incorporated herein by reference. These additional solvents may be used in conjunction with the solvents of the present invention. If the amount of additional solvent is kept low, the resultant composition would most likely have many of the desirable characteristics of the present invention. However, as the amount of these known solvents is increased, it is likely that undesirable properties of these known solvents would become manifest, such as darkening during burning. It is therefore preferable that substantially all of the solvents are selected from the group consisting of 12-hydroxystearic acid esters.

While a candle made of a composition having only a gellant and a solvent would be functional, such a candle is likely to suffer from several problems. For example, such a candle may exhibit tunneling, which may occur when the pool is significantly smaller than the candle diameter. The clarity of such a candle may be decreased by the addition of a fragrance or coloring agent, due to poor solubility of the fragrance or coloring agent in the solvent/gel composition. Other potential problems include syneresis, cracking and splitting due to thermal differentials when the candle is burning, and haziness. For example, compositions containing only VERSAMID® 1655 and octylhydroxystearate were shown to make functional candles that were just slightly hazy. Other components can be added to the composition to address these problems.

One or more solubilizers may be added to the composition of the present invention in a total amount of about 0–15% by weight, and preferably in an amount of about 7–12% by weight. Solubilizers improve the solubility of the gellant in the solvent, and thereby improve the clarity of the gellant/solvent blend. Solubilizers suitable for use with the present invention include isostearic acid, and branched chain fatty alcohols, such as isostearyl alcohol. Preferably, isostearyl alcohol is used as a solubilizer, because it is compatible with many other components that might be added to the composition. Solubilizers may also function as a coupling agent, which couple other components into the solution.

One or more emulsifiers may be added to the composition of the present invention in a total amount of about 0–7% by weight, preferably about 0–5% by weight, and more preferably in an amount of about 1–2% by weight. Emulsifiers improve the solubility of multi-component fragrance oils in the composition of the present invention, thereby improving clarity when fragrance molecules are present. Preferably, a nonionic emulsifier is used, because nonionic emulsifiers have good compatibility with compositions of the present invention. Preferably, the emulsifier is non-ethoxylated, i.e., does not have any ethoxyl groups, to avoid hazing. Preferably, the emulsifier is a sorbitan derivative. More preferably, the emulsifier is selected from the group consisting of sorbitan laurate, sorbitan palmitate, sorbitan stearate, sorbitan tristearate, sorbitan oleate, sorbitan trioleate, sorbitan sesquioleate. These sorbitan derivatives are commercially available from ICI Americas, and are sold under the trademarks SPAN® and ARLACEL®, with various alphanumeric designations for the different derivatives. More preferably, the emulsifier is selected from the group consisting of sorbitan laurate and sorbitan oleate. Most preferably, the emulsifier is sorbitan laurate.

One or more plasticizers may be added to the composition of the present invention in a total amount of about 0–10% by weight, preferably in an amount of about 0–5% by weight, and more preferably in an amount of about 1–2% by weight. Plasticizers increase the structural flexibility of compositions of the present invention, thereby allowing the compositions to deform slightly instead of cracking or splitting when subjected to the thermal stresses associated with burning a candle. Depending on the amounts of the other components, and in particular the amount of gellant, a plasticizer may not be needed to prevent cracking and splitting. Plasticizers suitable for use with the present invention include stearic acid; isopropyl palmitate; isopropyl myristate; linalool; α-terpineol; aldehyde C-14; dioctyl adipate; 1,2 benzenedicarboxylic acid, di-C6–8, branched alkyl ester (available commercially as JAYFLEX® 77 from Exxon Chemical Americas, located in Houston, Tex.); 1,2 benzenedicarboxylic acid, di-C8–10, branched alkyl ester (available commercially as JAYFLEX®DINP from Exxon Chemical Americas); pentaerythrityl tetracaprylate/tetracaprate (available commercially as CRODAMOL®PTC from Croda, Inc., located in Parsippany, N.J.); and pentaerythrityl tetraisostearate (available commercially as CRODAMOL®PTIS from Croda, Inc.). Some plasticizers may not be compatible with particular fragrance systems, which can cause hazing. 1,2 benzenedicarboxylic acid, di-C6–8, br alkyl ester (JAYFLEX®77) is a preferred plasticizer, because it exhibits compatibility with a wide variety of fragrance systems.

The choice of wicking material is also important in making an aesthetically acceptable transparent candle. Wicks containing a paper core have been observed to provide the most desired combination of burn characteristics, especially with respect to attributes such as smoke, bloom, fragrance throw and burn rate. Suitable wicks are commercially available from Atkins-Pearce of Covington, Ky.

The transparent candle compositions of the present invention may also contain a fragrance, for example, Citronella, AN114351 Sweet Peach, AN 114349 Mountain Berry, AN114350 Country Garden, AN114462 Lavender Meadows, AN114463 Strawberries 'N Cream and AN114215 Vanilla from Noville Corp., South Hackensack, N.J. Such fragrances are typically added in an amount of about 0% to 5% by weight, and preferably in an amount of about 2.5%, with the level being selected so as to achieve the desired throwing power.

The transparent candle compositions of the present invention may also contain a coloring agent, which produces a desired color appearance. A composition having a coloring agent would preferably be transparent, much like a clear colored gemstone such as a ruby or emerald.

After a candle has been fabricated from a composition of the present invention, a clear coating may be added to the outside of the candle. When taken out of the mold, the candle may have a surface comparable in hardness to that of a wax candle that might be marred, for example by a fingerprint. Suitable coatings have a hard surface that is not easily marred, and preferably adhere well to the candle. Such a coating may be applied by dipping the candle in a material that dries to form a hard, adherent coating. Suitable coating materials may be selected from the group consisting of acrylic acid polymers and polyamide resins, such as VERSAMID® 1655. Depending on its thickness, the coating may reinforce the candle sides, 1655 although the composition of the candle should be hard enough that such reinforcement is not necessary. Depending on the thickness and material of the coating, a thin walled coating shell may be left as the candle burns.

This invention will now be described in detail with respect to showing how certain specific representative embodiments thereof will be made, the materials, apparatus and process steps being understood as examples that are intended to be illustrative only. In particular, the invention is not intended to be limited to the methods, materials, conditions, process parameters, apparatus and the like specifically recited herein.

EXAMPLES OF THE INVENTION

Transparent candles representative of the present invention were prepared as follows:

(1) Octylhydroxystearate was added to a suitably sized container, which was agitated and heated to a temperature of 80° C.

(2) The gellant VERSAMID® 1655 was added, a little at a time, while the contents of the container were heated to 94-96° C and agitated. Heating and agitation were continued until a phase change was observed, indicating that substantially all of the hydroxy groups on the octylhydroxystearate had bound to the gellant.

(3) The composition was poured into a mold, and a wick was added while the composition was liquid. The composition was allowed to cool to room temperature and solidify.

The amount of gellant was varied between about 10% and 100%, with the amount of octylhydroxystearate correspondingly being varied between about 90% and 0%. For amounts of gellant above about 70%, tunneling was observed in the resultant candles. For amounts of gellant below about 40%, hazing, cracking, and syneresis were observed in the resultant candles. While the candles were transparent and functional, there was some small degree of haziness in all of the candles made of a composition of only octylhydroxystearate and VERSAMID® 1655.

Further transparent candles representative of the present invention were prepared as follows:

(1) The solvent was added to a suitably sized container, which was agitated and heated to a temperature of 80° C.

(2) The gellant was added, a little at a time, while the contents of the container were heated to 94–96 ° C. and agitated. No other components were added until a phase change was observed, indicating that the gellant had bound completely with the hydroxy group on the solvent.

(3) The other components were added, one at a time, stirring between each component. The components were added in an order determined by the amount of the component, from largest to smallest. Fragrance was added last. While a coloring agent was not used in the examples, any coloring agent would have been added after the other components. While this largest to smallest order, with the fragrance and coloring agent last, is preferred, the components other than the solvent and gellant may be added in any order.

(4) The composition was poured into a mold, and a wick was added while the composition was liquid. The composition was allowed to cool to room temperature and solidify.

While not intending to be limited by any theory of how the present invention works, it is believed that hydroxy groups on the solvent bind to the gellant, and that the best clarity is achieved when substantially all of the hydroxy groups on the solvent bind to the gellant. Because the solubilizer and other components may also have hydroxy groups that may bind to available sites on the gellant, it is believed that such components should not be added until after the gellant and solvent have been mixed for a time sufficient to allow substantially all of the hydroxy groups on the solvent to bind to the gellant, such that hydroxy groups on such components do not compete with the hydroxy groups on the solvent for binding sites on the gellant.

Using the above-noted procedure, the compositions listed in Table 1 were prepared:

TABLE 1

| Composition | 1 | 2 | 3 | 4 | 5 | 6 | 7 | 8 | 9 |
|---|---|---|---|---|---|---|---|---|---|
| Solvent | 37.5 | 39.5 | 31.0 | 48.0 | 17.0 | 31.0 | 36.0 | 41.0 | 24.0 |
| Gellant | 50.0 | 50.0 | 55.0 | 45.0 | 60.0 | 55.0 | 50.0 | 50.0 | 67.0 |
| Isostearyl alcohol | 8.0 | 8.0 | 10.0 | 5.0 | 10.0 | 5.0 | 5.0 | 4.0 | 3.0 |
| Fragrance | 2.5 | 2.5 | 3.0 | 2.0 | 3.0 | 3.0 | 3.0 | 3.0 | 5.0 |
| Isostearic acid | 0.0 | 0.0 | 1.0 | 0.0 | 10.0 | 5.0 | 5.0 | 0.0 | 0.0 |
| Plasticizer | 1.0 | 0.0 | 0.0 | 0.0 | 0.0 | 1.0 | 1.0 | 2.0 | 1.0 |
| Emulsifier | 1.0 | 0.0 | 0.0 | 0.0 | 0.0 | 0.0 | 0.0 | 0.0 | 0.0 |

For each of the compositions of Table 1, the solvent was octylhydroxystearate and the gellant was VERSAMID® 1655. Isostearyl alcohol and isostearic acid were both used as solubilizers, either individually or in a mixture. The plasticizer was 1,2 benzene dicarboxylic acid, di-C-6–8, branched alkyl ester (JAYFLEX® 77) in composition 1, and stearic acid in compositions 6–9. The emulsifier was sorbitan laurate (SPAN®20) in composition 1.

Candles made from each of the compositions of Table 1 were transparent and functional, although some of the compositions did not have as high a degree of clarity as others. Composition 1 is the preferred composition, because it shows the most desirable combination of properties, including a very high degree of clarity, and no cracking, syneresis, or darkening during burning.

What is claimed is:

1. A clear solid candle, comprising:

(a) a composition that serves as the base material for the candle, the composition further comprising:

(i) one or more polyamides, wherein the total weight of the polyamides is about 40–70% by weight of the composition; and (ii) one or more 12-hydroxystearic acid ester solvents, wherein a 12-hydroxystearic acid ester solvent has the following chemical structure:

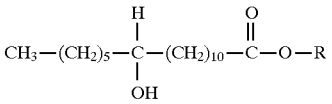

and wherein R is selected from the group consisting of alkyl radicals, aryl radicals, and arylalkyl radicals; and (b) a wick embedded in the composition.

2. The candle of claim 1, wherein the polyamides are one or more polyamide resins.

3. The candle of claim 2, wherein the total weight of the polyamides is about 50–60% by weight of the composition.

4. The candle of claim 1, wherein the total weight of the 12-hydroxystearic acid ester solvents is at least about 10% by weight of the composition.

5. The candle of claim 1, wherein the total weight of the 12-hydroxystearic acid ester solvents is at least about 20% by weight of the composition.

6. The composition of claim 5, wherein the total weight of the 12-hydroxystearic acid ester solvents is about 35–45% by weight of the composition.

7. The composition of claim 1, wherein R is selected from the group consisting of:

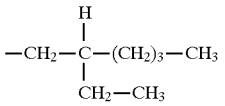

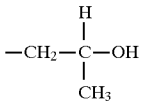

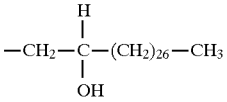

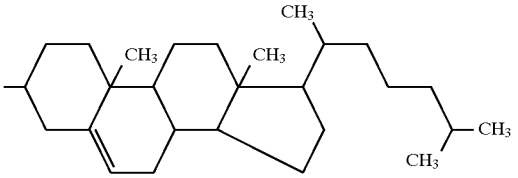

$-C_{10}H_{21}$ and $-(CH_2)_2-OH$.

8. The composition of claim 1, wherein one of the 12-hydroxystearic acid ester solvents has the following chemical structure:

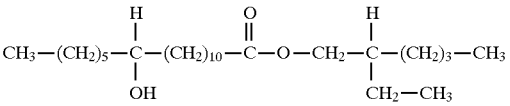

9. The candle of claim 1, wherein the composition further comprises one or more additional solvents.

10. The candle of claim 1, wherein the composition further comprises one or more solubilizers, wherein the total weight of the solubilizers is between about 0–15% by weight of the composition.

11. The composition of claim 10, wherein the solubilizers are selected from the group consisting of isostearic acid and branched chain fatty alcohols.

12. The composition of claim 11, wherein one of the solubilizers is isostearyl alcohol.

13. The candle of claim 1, wherein the composition further comprises one or more emulsifiers, wherein the total weight of the emulsifiers is between about 0–7% by weight of the composition.

14. The composition of claim 13, wherein the emulsifiers are selected from the group consisting of nonionic emulsifiers.

15. The composition of claim 13, wherein the emulsifiers are selected from the group consisting of non-ethoxylated emulsifiers.

16. The composition of claim 14, wherein the emulsifiers are selected from the group consisting of sorbitan derivatives.

17. The composition of claim 16, wherein one of the emulsifiers is sorbitan laurate.

18. The candle of claim 1, wherein the composition further comprises one or more plasticizers, wherein the total weight of the plasticizers is between about 0–10% by weight of the composition.

19. The candle of claim 18, wherein the plasticizers are selected from the group consisting of: stearic acid; isopropyl paimitate; isopropyl myristate; linalool; α-terpineol; aldehyde C-14; dioctyl adipate; 1,2 benzenedicarboxylic acid di-C6–8, branched alkyl ester; 1,2 benzenedicarboxylic acid, di-C8–10 branched alkyl ester; pentaerythrityl tetracaprylate/tetracaprate; and pentaerythrityl tetraisostearate.

20. The candle of claim 18, wherein one of the plasticizers is 1,2 benzenedicarboxylic acid di-C6–8, bromide alkyl ester.

21. The candle of claim 1, further comprising one or more fragrances in a total amount of between about 0–5%.

22. A clear solid candle, comprising:

at least about 10% by weight octylhydroxystearate;

about 40–70% by weight polyamide resin;

about 0–15% by weight isostearyl alcohol;

about 0–7% by weight sorbitan laurate;

about 0–10% by weight 1,2 benzene dicarboxylic acid, di-C6–8, branched alkyl ester; and about 0–5% by weight fragrance.

23. The candle of claim 22, wherein the candle comprises a composition that further comprises:

about 37.5% by weight octylhydroxystearate;

about 50% by weight polyamide resin;

about 8% by weight isostearyl alcohol;

about 1% by weight sorbitan laurate;

about 1% by weight 1,2 benzene dicarboxylic acid, di-C6–8, branched alkyl ester; and about 2.5% by weight fragrance.

24. The candle of claim 1, further comprising a clear coating surrounding the composition.

25. A method of making a clear solid candle, comprising the steps of:

a) heating one or more 12-hydroxystearic acid ester solvents, wherein a 12-hydroxystearic acid ester solvent has the following chemical structure:

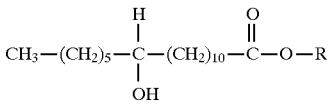

and wherein R is selected from the group consisting of alkyl radicals, aryl radicals, and arylalkyl radicals;

b) mixing one or more polyamides with the one or more 12-hydroxystearic acid ester solvents wherein the total amount of polyamides is about 40–70% by weight of a clear composition used to make the candle;

(c) cooling the result of the step of mixing to room temperature.

26. The method of claim 25, wherein the total amount of 12-hydroxystearic acid ester solvents is at least about 10% by weight of the clear composition.

27. The method of claim 26, wherein the total amount of 12-hydroxystearic acid ester solvents is at least about 20% by weight of the clear composition.

28. The method of claim 27, wherein the total amount of 12-hydroxystearic acid ester solvents is about 35–45% by weight of the clear composition.

29. The method of claim 25, wherein the polyamides include one or more polyamide resins.

30. The method of claim 29, wherein the polyamides include one or more polyamide resins, and wherein the total amount of polyamides is about 50–60% by weight of the clear composition.

31. The method of claim 25, wherein R is selected from the group consisting of:

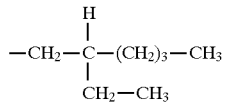

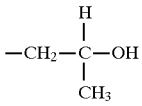

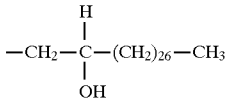

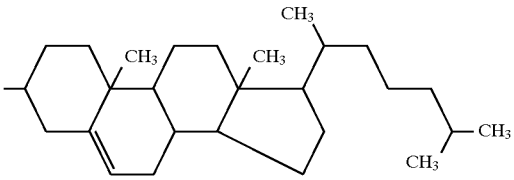

$-C_{10}H_{21}$ and $-(CH_2)_2-OH$.

32. The method of claim 25, wherein one of the 12-hydroxystearic acid ester solvents has the following chemical structure:

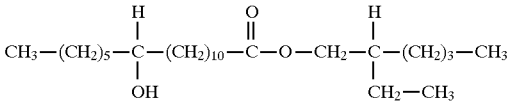

33. The method of claim 25, further comprising the step of adding one or more components, selected from the group consisting of: solubilizers, emulsifiers, plasticizers, fragrances, and coloring agents, to the result of the step of mixing one or more polyamide with the one or more 12-hydroxystearic acid ester solvents.

34. The method of claim 33, further comprising the step of waiting until a phase change occurs, after the step of mixing one or more polyamide with the one or more 12-hydroxystearic acid ester solvents, and before the step of adding one or more components.

* * * * *

UNITED STATES PATENT AND TRADEMARK OFFICE

CERTIFICATE OF CORRECTION

PATENT No. : 5,882,363

DATED : May 16, 1999

INVENTOR(S): Laura A. Spaulding and Robert V. Burke

It is certified that error appears in the above-identified patent and that said Letters Patent is hereby corrected as shown below:

Column 4, line 34, "composition at least about 10% by weight" should be changed to -composition (at least about 10% by weight)-;

Column 4, line 35, "weight at least 20% by weight" should be changed to -weight (at least 20% by weight)-;

Column 9, line 63, "composition" should be changed to -candle-;

Column 9, line 66, "composition" should be changed to -candle-;

UNITED STATES PATENT AND TRADEMARK OFFICE

CERTIFICATE OF CORRECTION

PATENT NO. : 5,882,363

DATED : May 16, 1999

INVENTOR(S) : Laura A. Spaulding and Robert V. Burke

It is certified that error appears in the above-identified patent and that said Letters Patent is hereby corrected as shown below:

Column 10, line 57, "composition" should be changed to -candle-;

Column 10, line 63, "composition" should be changed to -candle-;

Column 10, line 65, "composition" should be changed to -candle-;

Column 11, lines 1 and 4, "composition" should be changed to -candle-; and

Column 11, line 18, "bromide alkylester" should be changed to -branched alkyl ester-.

Signed and Sealed this

Fifteenth Day of February, 2000

*Attest:*

Q. TODD DICKINSON

*Attesting Officer*

*Commissioner of Patents and Trademarks*